US010088214B2

(12) United States Patent
Harms

(10) Patent No.: US 10,088,214 B2
(45) Date of Patent: Oct. 2, 2018

(54) COOLING BOTTLE HOLDER

(71) Applicant: Cigdem Harms, Las Vegas, NV (US)

(72) Inventor: Cigdem Harms, Las Vegas, NV (US)

( * ) Notice: Subject to any disclaimer, the term of this patent is extended or adjusted under 35 U.S.C. 154(b) by 463 days.

(21) Appl. No.: 14/516,011

(22) Filed: Oct. 16, 2014

(65) Prior Publication Data

US 2016/0109176 A1 Apr. 21, 2016

(51) Int. Cl.
*F25D 3/08* (2006.01)
*F25D 31/00* (2006.01)
*A47G 23/02* (2006.01)

(52) U.S. Cl.
CPC ..... *F25D 3/08* (2013.01); *F25D 31/007* (2013.01); *A47G 23/0241* (2013.01); *A47G 2023/0275* (2013.01); *F25D 2303/0832* (2013.01); *F25D 2303/0843* (2013.01); *F25D 2331/803* (2013.01); *F25D 2331/809* (2013.01)

(58) Field of Classification Search
CPC ..... F25D 3/08; F25D 2303/082; F25D 2303/0821; F25D 2303/0832; F25D 2303/0841; F25D 2303/0843; F25D 2331/803; F25D 2331/809; F25D 31/007; F25D 3/14; F25D 2303/083; F25D 2303/0846; F25D 2331/805; F25D 31/006; F25D 23/062; F25D 2303/08221; A47G 2023/0275; A47G 23/0241; A47G 23/0313; A47G 23/0316; A47G 23/0683
USPC ..... 62/381, 457.2, 457.4, 457.8, 465; 220/628, 630, 737; 248/146–154, 159
See application file for complete search history.

(56) References Cited

U.S. PATENT DOCUMENTS 3,365,911 A * 1/1968 Stoner et al. ..... F25D 3/08 62/457.4
3,434,302 A * 3/1969 Stoner ..... F25D 3/00 165/46

(Continued)

FOREIGN PATENT DOCUMENTS

DE 19921550 A1 * 11/2000 ..... A47F 7/283
GB 2286449 A * 8/1995 ..... B65D 81/3883

(Continued)

OTHER PUBLICATIONS

Juvinall, Robert C., and Kurt M. Marshek. Fundamentals of machine component design, fourth ed. New York: John Wiley & Sons, 2006; pp. 56-58.*

(Continued)

*Primary Examiner* — Hung Q Nguyen
*Assistant Examiner* — Mark L Greene
(74) *Attorney, Agent, or Firm* — Ronald C. Gorsche

(57) ABSTRACT

The present disclosure relates to a device for holding a bottle, in particular the bottle holder includes a stand, the stand including a base portion, an angled stand portion, and an annular holding portion. The base portion is configured to rest against a supportive surface, and the angled stand portion extends upward away from the base portion. The angled stand portion can include first and second prongs forming a primary void in a front planar face therebetween. An annular holding portion extends rearwardly from the front planar face between the first and second prongs. A cooling insert can be provided which is configured to rest in the annular holding portion and provide cooling to a bottle contained therein.

15 Claims, 12 Drawing Sheets

(56) References Cited

U.S. PATENT DOCUMENTS

| | | | | | |
|---|---|---|---|---|---|
| 4,505,132 | A * | 3/1985 | Howes | F25D 3/06 | 62/272 |
| 5,577,779 | A * | 11/1996 | Dangel | E05C 19/06 | 220/326 |
| 6,085,926 | A * | 7/2000 | Weiss | A45C 11/20 | 206/514 |
| 8,397,519 | B2 * | 3/2013 | Loibl | F25D 31/007 | 62/3.62 |
| 2004/0204169 | A1 * | 10/2004 | Goradesky | H04B 1/3877 | 455/569.1 |
| 2005/0005631 | A1 * | 1/2005 | DeMars | A47G 23/08 | 62/457.6 |

FOREIGN PATENT DOCUMENTS

| | | | | |
|---|---|---|---|---|
| WO | WO 2008000943 | A1 * | 1/2008 | A47F 7/283 |
| WO | WO 2009043609 | A1 * | 4/2009 | A47G 23/0241 |

OTHER PUBLICATIONS

WO 2008/000943 A1 (machine translation).*
Bergfeld, DE 19921550, Nov. 23, 2000, machine translation.*

* cited by examiner

COOLING BOTTLE HOLDER

COPYRIGHT STATEMENT

A portion of the disclosure of this patent application document contains material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The disclosure relates to methods and device for displaying a bottle in an aesthetically pleasing manner. More specifically, the methods and device described herein relate to a bottle holder being capable of keeping the contents of a bottle chilled while on display for extended periods of time.

2. Description of the Prior Art

Previous methods of keeping bottles, and particularly their contents, cool, have often included placing the bottle in a small bucket or container having ice. Such methods are often employed in restaurants or the like for cooling wine or other beverages. By placing the bottle in the ice water, the beverage contained therein can be maintained at a near freezing temperature for extended periods of time, so long as ice in the container or bucket is present, and melting, the temperature can be maintained at or near the melting temperature of the ice or ice water, i.e. zero degrees Celsius or 32 degrees Fahrenheit.

While in function, this method has proved adequate as far as keeping the bottle cool, the water which contacts the bottle has proved to have some undesirable effects. One such effect includes the degradation or destruction of the label on the bottle. In certain formal settings, either public or private, the persons drinking the contents of the bottle may often wish to read the label, or the owner of the bottle might want to merely display the bottle in a pleasing manner and encourage patrons to request a taste of the contents, such as at a wine tasting or otherwise. Regardless, it has been appreciated by the applicant that there are numerous situations where an end user might wish to keep the label intact and dry for presentational purposes. Another effect of water actually coming into contact with the bottle is that when the bottle is removed from the container, the water can often drip onto the surrounding areas as the bottle is maneuvered for pouring or drinking. It has been appreciated by the applicant that, particularly in formal settings, that this water dripping onto the clothes or surrounding area, or the floor, can cause harm to clothing or other items, or present a slipping hazard. Regardless, these water droplets typically require additional effort to clean up. These as well as other disadvantages can be overcome by the present invention.

Applicant, therefore, has recognized that a need exists for a bottle stand which provides for an aesthetically pleasing display of bottles being supported by the stand which reduces the contact of the bottle itself to melting ice and thereby water and maintains the integrity of the label, and reduces the spread of water droplets around the bottle's location. The present application seeks to address and overcome many of these concerns.

SUMMARY OF THE INVENTION

The methods and device described herein provide a device which allows for a bottle holder which is both aesthetically pleasing as well as keeps the bottle contained therein dry and does not drip water or degrade the label placed thereon.

One embodiment of the present invention includes a bottle holder having a stand, wherein the stand includes a base portion, an angled stand portion extending upward and away from the base portion. The angled stand portion includes first and second prongs forming a primary void in a front planar face. The stand further includes an annular holding portion extending rearwardly from the front planar face between the first and second prongs. The bottle holder further includes a removable face plate configured to engage with the front planar face of the angled stand portion of the stand. The angled stand portion is further configured to receive a cooling insert which rests in the annular holding portion between the removable face plate and the stand.

In another embodiment of the present invention, A bottle holder assembly is contemplated which includes a stand, an annular holding portion, and a cooling insert.

The stand can include the following: a base portion, the base portion configured to rest against a supportive surface, an angled stand portion, extending upward away from the base portion and having first and second prongs forming a primary void in a front planar face therebetween, and a face plate configured to engage with the front planar face of the angled stand portion of the stand. The annular holding portion can be removably coupled to a rear surface of the angled stand portion and extend rearwardly from the front planar face between the first and second prongs substantially closing the primary void. The cooling insert can also be configured to rest in the annular holding portion.

In yet another embodiment of the present invention, a bottle holder assembly is contemplated which includes a plurality of angled stands. Each of the plurality of angled stands can be coupled to a base portion which rests against a supportive surface. Each of the plurality of angled stands can extend upward and away from the base portion each angled stand having first and second prongs forming a primary void in a front planar face therebetween for each angled stand. Each angled stand can further include a face plate configured to engage with the front planar face of each angled stand;

Further, a plurality of annular holding portions can be coupled to a rear surface of each of the angled stand portions, the annular holding portions extending rearwardly from the front planar face between the first and second prongs of each of their respective angled stand portions, each annular holding portion substantially closing their respective primary voids.

Then a plurality of cooling inserts can be provided which are configured to rest in each of the annular holding portions.

These and other embodiments are described in more detail herein.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION OF VARIOUS EMBODIMENTS OF THE INVENTION

Mankind has been trying to keep beverages cool essentially since the beginning of time. In that time period beverages have been contained in various vessels and placed in cold places in order to cool the liquid contained therein. More recently, glass bottles or metallic cans have been utilized to contain various beverages. As discussed above, placing the bottle or metallic can into cool water can provide desired cooling to the vessels contents. However, for more sophisticated venues and more sophisticated beverages, for example, wine bottles in a restaurant setting, a more sophisticated cooling method than merely placing the wine bottle in a nearby stream might be desirable.

In the case of particularly sophisticated or expensive wine bottles the serving establishment or even the drinkers themselves might often want to place the desired wine bottle in a holder which compliments or augments the appearance of the bottle, or the label on the bottle itself, for informational or prestige minded concerns. Also, as discussed above, and particularly in restaurant settings, water dripping from the bottle while it is being maneuvered for pouring has the potential of falling onto the floor and presenting a slip and fall hazard, and thereby necessitate the prompt cleaning of such drops. In addition, the water droplets can also fall onto the table settings and linens and thereby necessitate cleaning. Further, such falling droplets can also fall onto and either ruin or stain patron's clothing or otherwise cause displeasure to the patrons.

The present application seeks to provide a bottle holding device, which maintains or augments the appearance and integrity of a bottle and its associated label. The bottle holding device further prevents the buildup of water on the bottle which it holds and thus prevents the dripping or spread of water droplets by the maneuvering of the bottle for pouring.

For purposes of this disclosure, a void can refer to any of a cavity, hole, channel, opening, slit, or other gap which can be either spanned or otherwise filled by another component or material. Concave refers to any recess in a surface or any cavity to which held in a proper orientation can contain a liquid. Further, hereinafter any reference to annular includes any shape be it geometric or amorphous which has a substantially continuous outer wall that defines a hollow space encircled by such a wall.

In one embodiment, the bottle holder is described as a bottle holder having a base, a removable face plate, and a cooling insert.

Figure 1:
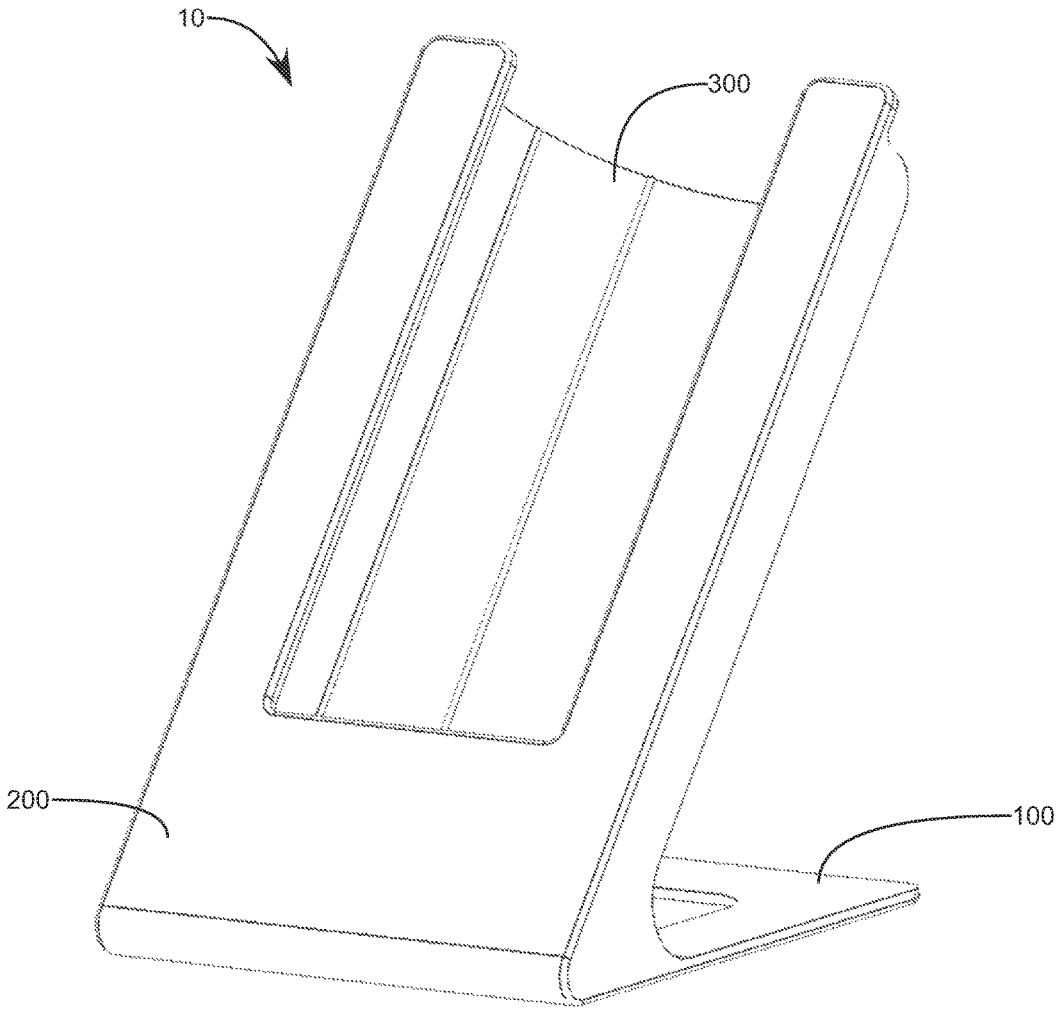
FIG. 1 illustrates a perspective view of the front of a bottle stand assembly in accordance with one embodiment.

FIGS. 1-7 illustrate such an embodiment of a bottle holder assembly, shown generally at 10. FIG. 1 shows an assembled isometric view of the bottle holder assembly 10, which includes a stand 100, a removable face plate 200, and a cooling insert 300. The bottle holder assembly 10 is designed to rest on a diner's table, a counter, or otherwise be placed on display wherein the stand 100 provides support to the rest of the assembly. The cooling insert 300 can be filled with a freezable gel or other phase change material and placed into the bottle holder assembly 10 so as to provide a cooling effect to a bottle held by the bottle holder assembly 10 and thereby maintain the liquid contained therein at a desired drinking temperature. The removable face plate 200 can have indicia, or other suitable designs provided thereon such that a desired removable face plate having a desired design can be used which compliments the particular scene or setting in which the bottle holder assembly 10 resides.

Figure 2A:
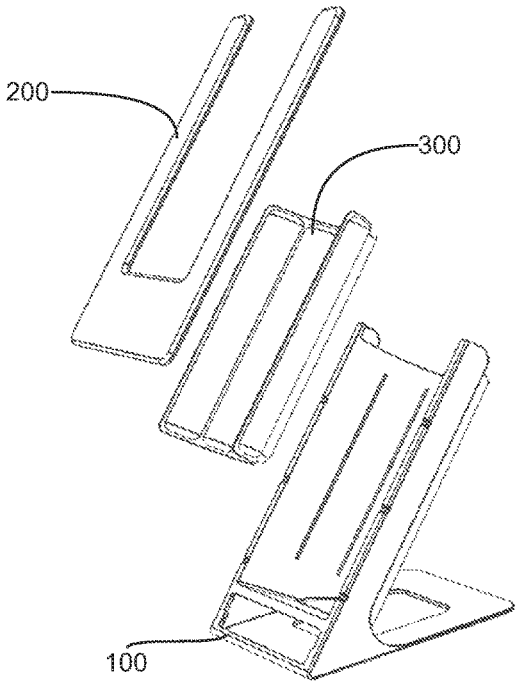
FIGS. 2A-B illustrate various exploded views of a bottle stand assembly in accordance with the embodiment of FIG. 1.
Figure 2B:
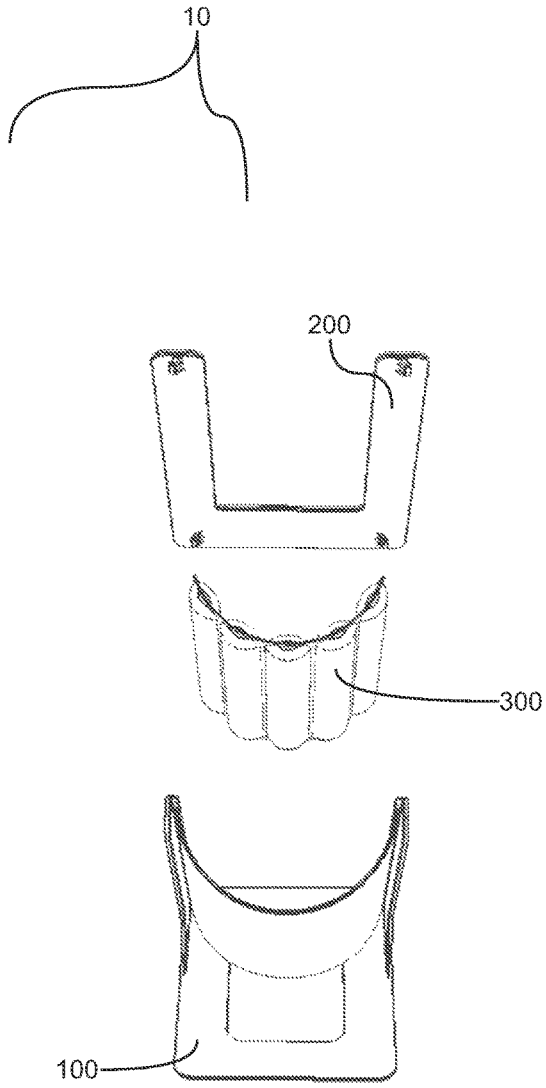

FIGS. 2A-B show isometric and rear exploded views of the bottle holder assembly 10 wherein each of the stand 100, the removable face plate 200, and the cooling insert 300 can be viewed in better detail and better illustrate how each component interacts with the others.

Figure 3A:
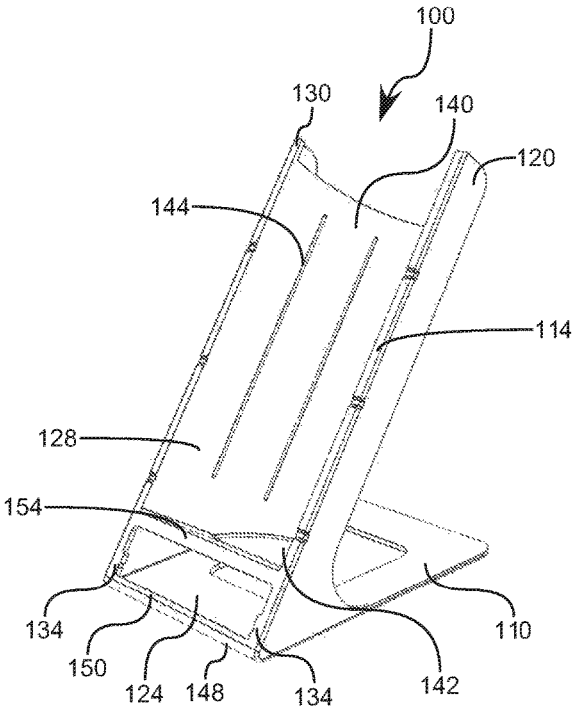
FIGS. 3A-C illustrate various views of a stand portion of the bottle stand assembly in accordance with the embodiment of FIG. 1.
Figure 3B:
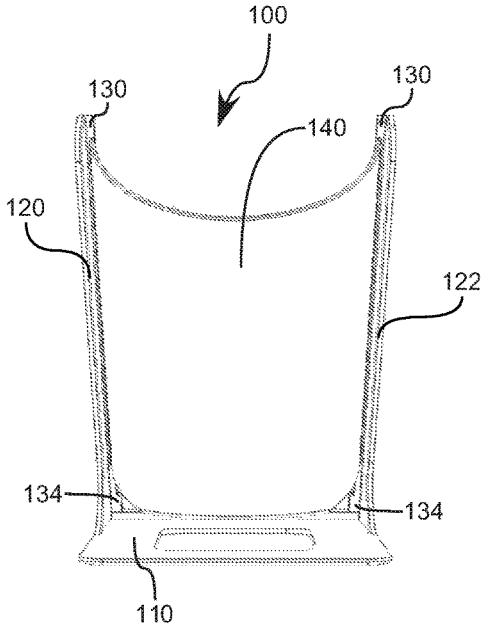
Figure 3C:
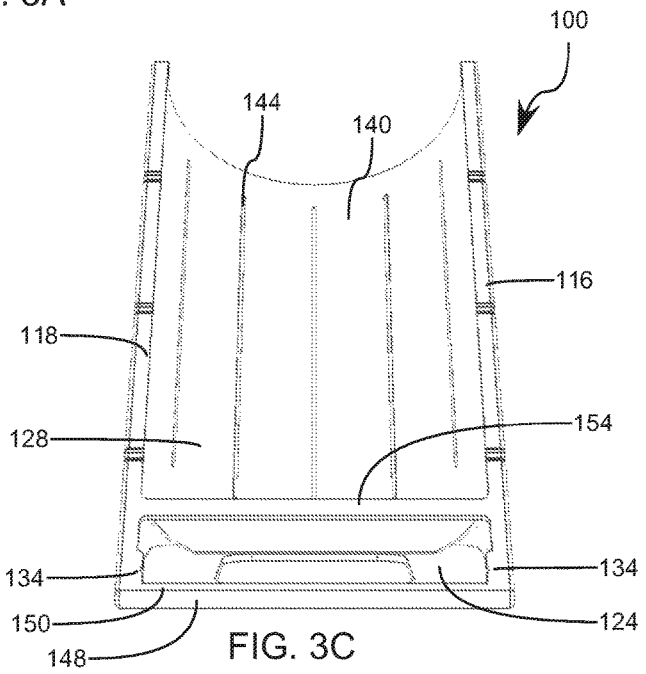

FIGS. 3A-C illustrate various views of the stand 100. The stand 100 can include various features which aid in the functionality of the bottle holder assembly to which it forms part. The stand 100 can include a base portion 110 which can be provided as a flat or otherwise planar surface which can be configured to rest against a supportive surface, i.e. a table, shelf, or counter. The stand 100 can further include an angled stand portion 114 which extends upward and away from the base portion. The angled stand portion 114 can include first and second prongs 116 and 118 respectively which create a primary void 128 formed therebetween. The primary void 128 acts as an opening configured to receive a bottle to be held by the bottle holder assembly.

The first and second prongs 116 and 118 can extend away in a common plane which will be referred to herein as the front planar face, the front planar face providing a flat or planar surface against which the removable face plate can properly and stably rest. The first and second prongs 116 and 118 can be provided with additional strength and support by a pair of stiffening ridges 120 and 122 respectively which can be provided as planar wedge shapes placed in the acutely angled portion between the base portion 110 and each of their respective prongs. These stiffening ridges reduce the deflection of the first and second prongs under the weight of the bottle, and increase the durability of the bottle holder assembly and reduce wear during cleaning and storage applications.

The primary void 128 can be enclosed by an annular holding portion 140 which extends rearwardly from the front planar face and extends between, and can be affixed to the first and second prongs, 116 and 118, at respective edges. The annular holding portion 140 is configured to provide a surface against which a wall of a bottle placed in the bottle holder can rest, and thereby provide support.

The annular holding portion 140 can be provided with a series of ridges 144 on its interior surface which are configured to interferingly engage with an outer surface of a cooling insert placed therein, not shown. These ridges can thus stabilize the angular position of the cooling insert and prevent the rotation of a bottle contained by the bottle holder from imparting rotation to the cooling insert and potentially twisting the insert out of the annular holding portion 140.

One problem encountered when presenting a cold bottle at a room temperature, is that water vapor inherently exists in the air. When water which exists at room temperature is exposed to a cold surface, condensation often occurs, particularly in humid areas. In order to mitigate the effect of condensation and reduce the number of droplets spread during pouring or other maneuvering, the annular holding portion can further be provided with a reservoir cavity 142. The reservoir cavity can act to collect condensed water below the bottle and provide a place to rest until proper disposal or cleaning can be performed.

The reservoir cavity 142 can extend below a support bar 154 which resides at a lower portion between the first and second prongs, 116 and 118 respectively. The support bar provides a holding edge which is configured to hold a bottom surface of a bottle contained by the bottle holder. The reservoir cavity 142 extends below the support bar 154 and provides a reservoir wherein any water which might condense on the bottle can fall away from and out of contact with the bottle. The reservoir cavity 142 can also allow any condensation which forms on the cooling insert (not shown) to also drip away and out of contact with the bottle contained in the bottle holder assembly.

In order to provide a seamless aesthetically pleasing appearance to a frontal display surface of the bottle holder assembly, the base portion 110 can be provided with a front lip portion 148 which can be bent around a front edge of the stand portion 100 until it is parallel with the front planar face. The front lip portion 148 can thus provide an flush edge 150 against which the face plate (not shown) can rest in a locked position or configuration such that the surface of the face plate and the front lip portion are properly aligned and have essentially no void therebetween. This flush mating between the front lip portion and the face plate having no void can be readily seen in FIG. 1.

Figure 4A:
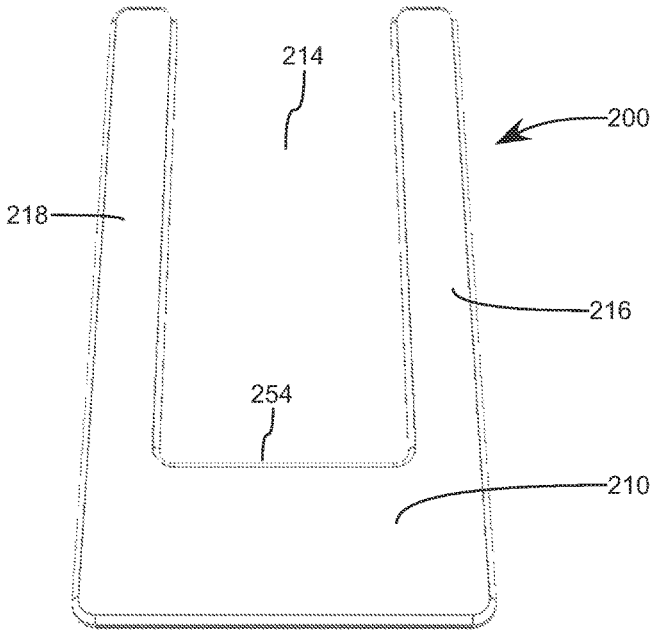
FIG. 4A-B illustrate various views of a face plate portion of the bottle stand assembly in accordance with the embodiment of FIG. 1.
Figure 4B:
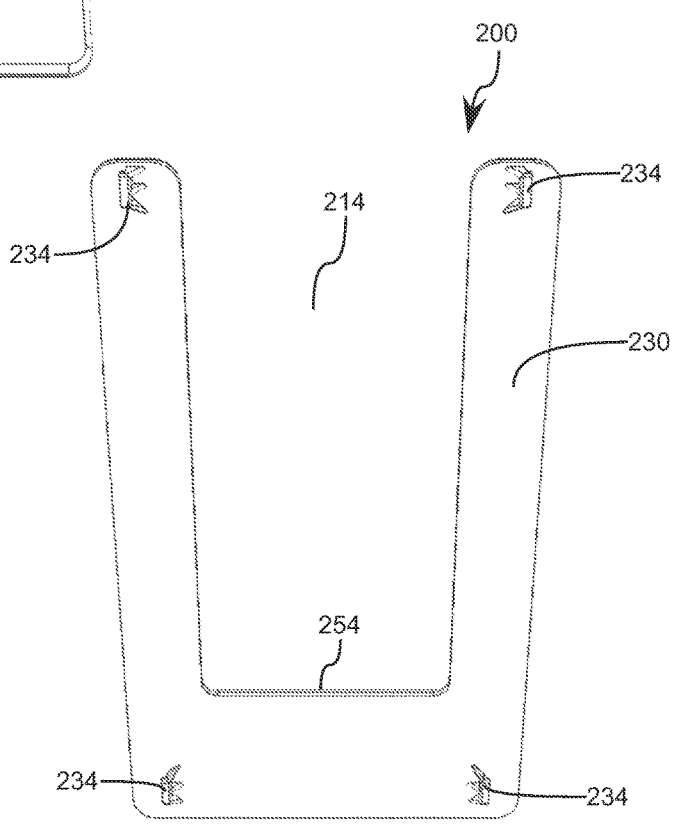

As discussed briefly above, the removable face plate 200 is configured to engage with the front planar face of the angled stand portion 114 of the stand 100. This interface between these two components will be discussed herein with reference to FIGS. 3-4. The removable face plate is shown in FIGS. 4A-B and mates with the front planar face of the angled stand portion 114, as shown in FIGS. 3A-C. Between these components is provided a sliding lock system, wherein one or more first components of the sliding lock system resides on the angled stand portion 114, shown herein as tabs, 130 and 134, residing at respective top and bottom regions of the angled stand portion 114. One or more second components 234 of the sliding lock system reside on a rear surface 230 of the removable face plate 200. In the present embodiment the second component of the sliding lock system is shown as a plurality of channeled extensions. The locations of the first and second components of the sliding lock system are configured to mesh and provide a secure placement of the face plate 200 with respect to the front planar face of the angled stand portion 114.

In the embodiment shown, the removable face plate is placed against the front planar face of the angled stand portion such that the upper most second components located on the removable face plate are above the first and second prongs 116 and 118 respectively and the lower most second components pass through a notch or a slot which resides in a secondary void 124 located at the bottom of the angled stand portion. By sliding the removable face plate 200 downward toward the bottom of the front planar face, the second components 234, i.e. the channeled extensions, slide over and engage the first components 130 and 134, i.e. the tabs, such that the sliding lock system is engaged and the bottom edge of the removable face plate abuts against the flush edge 150 of the stand 100.

The removable face plate 100 can further be provided with designs or patterns on the front face 210 and can be interchanged so as to change the appearance of the bottle holder assembly. The removable face plate can further be provided with a pair of prongs 216 and 218 which act to cover the first and second prongs 116 and 118 of the stand 100. The prongs form a coinciding central void 214 which coincides with the primary void 128 of the stand 100. The central void 214 can further have a support edge 254 which coincides with the holding edge of the support bar 154 of the stand 100 when in the locked position.

In the embodiment shown, that tabs are formed on the stand 100 and corresponding channels are formed on the removable face plate 200. It will be appreciated that those skilled in the art would recognize that the placements of these respective components can be reversed wherein channels are provided on the stand 100 and tabs formed on the removable face plate 200.

It will be further appreciated that alternative sliding lock systems including hooks, magnetic fasteners, or any other suitable mechanism for securely holding the removable face plate into proper position with respect to the stand also fall within the scope of the present invention.

Figure 5A:
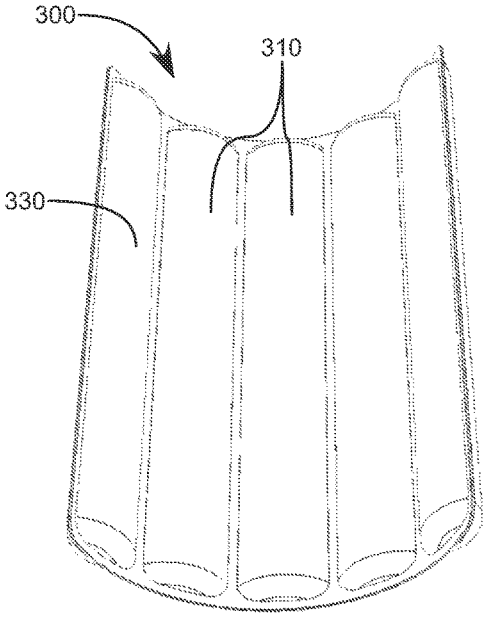
FIG. 5A-B illustrate front and back perspective views of one embodiment of a cooling insert for use with the bottle stand assembly of FIG. 1.
Figure 5B:
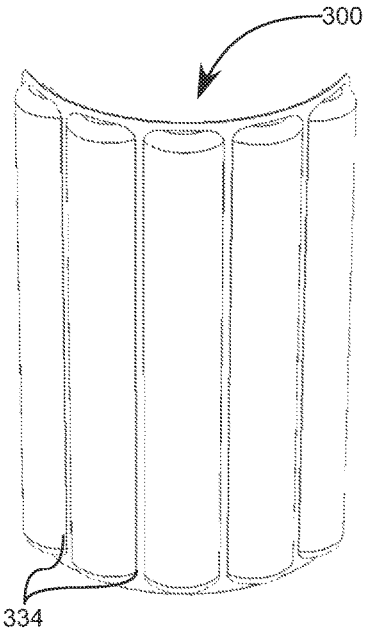

FIGS. 5A-B illustrate front and rear views of a cooling insert 300, for use with the various embodiments of the present invention. The depicted embodiment of the cooling insert 300 has a plurality of chambers 310 which can contain a phase change liquid such as water or freezable gel. It will be appreciated that a single chamber can also be provided.

The cooling insert 300 can be placed in the annular holding portion of the bottle holding assembly, and be placed in contact with a bottle being held by such. In this manner, heat transfer can occur between the cooling insert and the bottle's contents, thereby maintaining the bottle's contents at near the melting point temperature of the phase change liquid, i.e. 32 degrees Fahrenheit for water. Further, the contained phase change liquid does not exit the cooling insert when it melts from liquid to solid, and therefore it does not actually wet the surface of a bottle coming into contact therewith. In this manner the integrity of a label of the bottle can be maintained, and droplet formation on the bottle itself is mitigated.

It will further be recognized by those skilled in the art that increasing the contact area between the cooling insert 300 and the bottle (not shown) will increase the heat transfer rate, and allow for more even and faster cooling of the bottle's contents. Therefore, in one aspect of the present invention, the interior surface 330 of the cooling insert 100 is provided from a malleable material which allows the interior surface 330 to conform in shape to the surface of the bottle placed into the annular holding portion. This malleable surface can be achieved by various waterproof plastics and fabrics which can readily contain the phase change fluid, but allow for a high contact area between the respective surfaces and thereby the contents. The exterior surface can be provided as a rigid or malleable surface.

It will be further recognized that by having a plurality of vertically oriented chambers 310, a series of channels 334 are formed, one between each chamber. These channels 334 can coincide with the ridges 144 formed on the interior surface of the annular holding portion, and thereby prevent rotation of the cooling insert when rotation is imparted to the bottle. It will be further appreciated that the removable face plate can have a portion which extends inwardly toward the central void at least some distance past the first and second prongs of the stand so as to further limit rotation of the cooling insert with a rotating bottle.

Figure 6A:
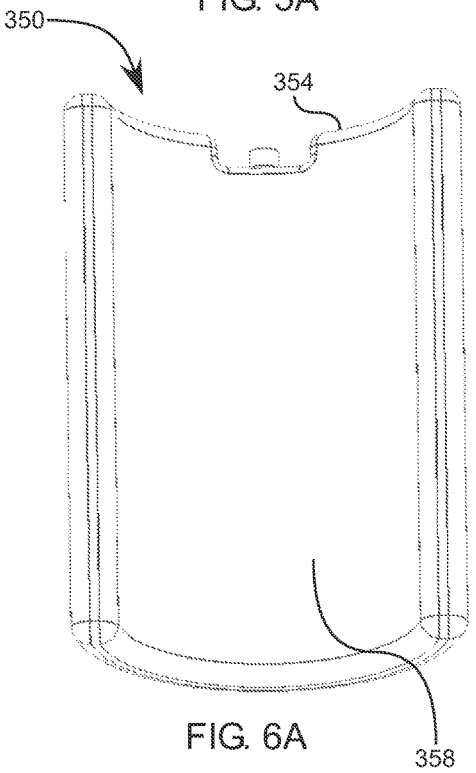
FIG. 6A-B illustrate front and back perspective views of an alternative embodiment of a cooling insert for use with the bottle stand assembly of FIG. 1.
Figure 6B:
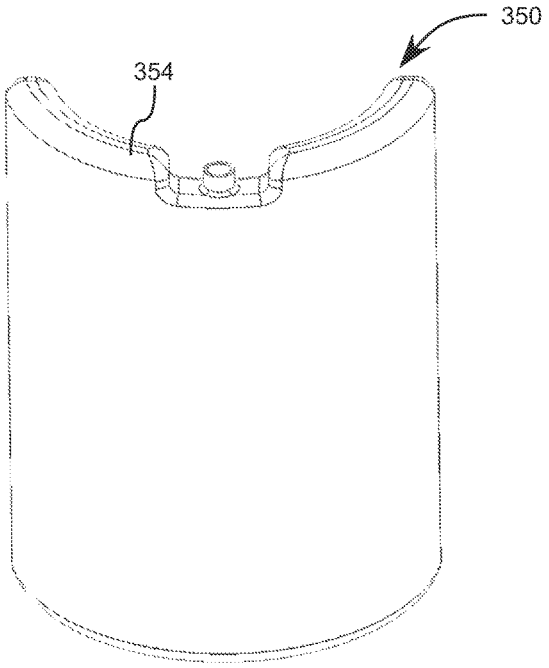

FIGS. 6A-B illustrate an alternative cooling insert 350 having a substantially rigid but resilient body portion 354. This cooling insert 350 also contains a phase change liquid and can be allowed to flex slightly in response to the weight of a bottle being placed in the annular holding portion. The interior surface 358 can be provided as a substantially rigid material wherein the substantially rigid but resilient body allows for minor conformation of the interior surface 354 to the radius of a bottle being held by the annular holding portion of the stand.

Figure 7:
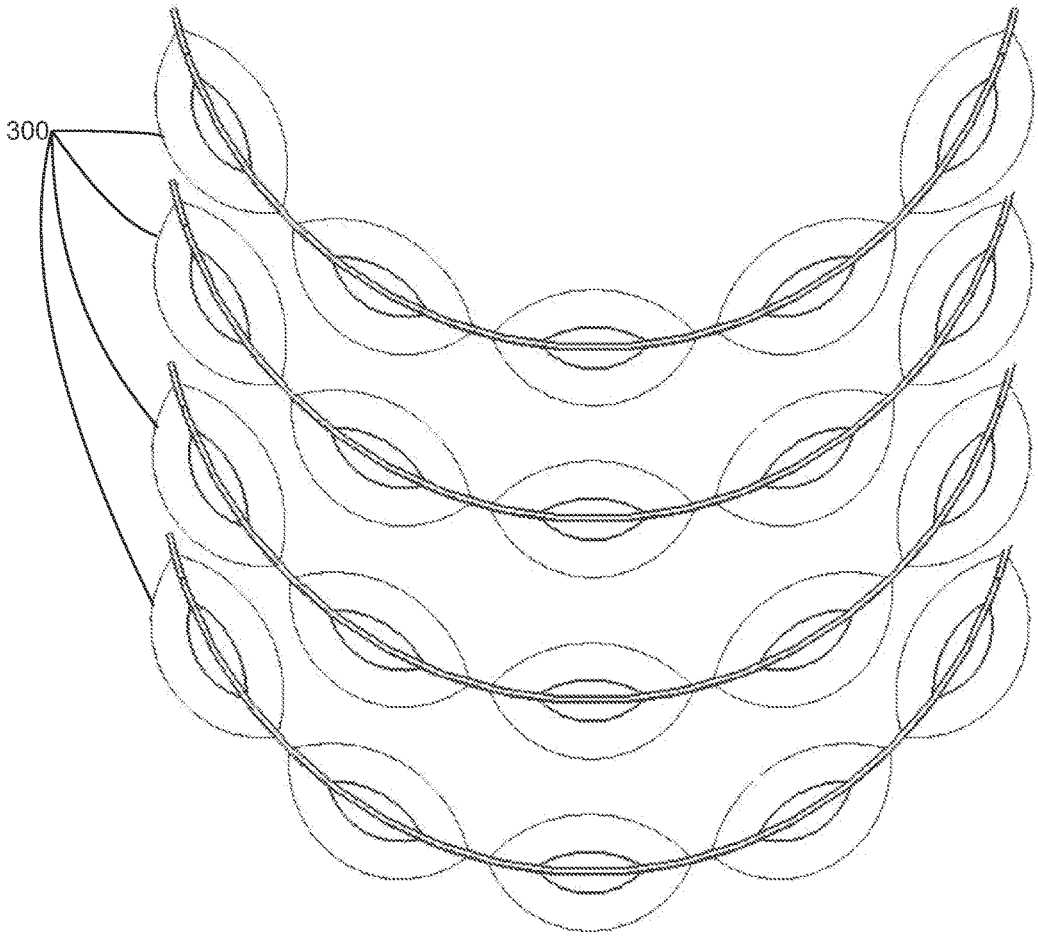
FIG. 7 illustrates an end view of the cooling insert of FIG. 5 in a nesting configuration.

FIG. 7 illustrates an end view of a plurality of cooling inserts 300 in accordance with the embodiment of FIG. 5 wherein the cooling inserts can be removed from the annular holding portion and nested with other cooling inserts for the purposes of shipping and/or placing in a freezer to re-freeze the phase change liquid contained therein. By being sized and shaped in a manner that allows nesting, the space required for freezing is greatly reduced. Also by having both interior and exterior walls of the cooling inserts 300 formed of a malleable material, the nesting can be provided in even tighter configurations, than rigid bodies.

Figure 8:
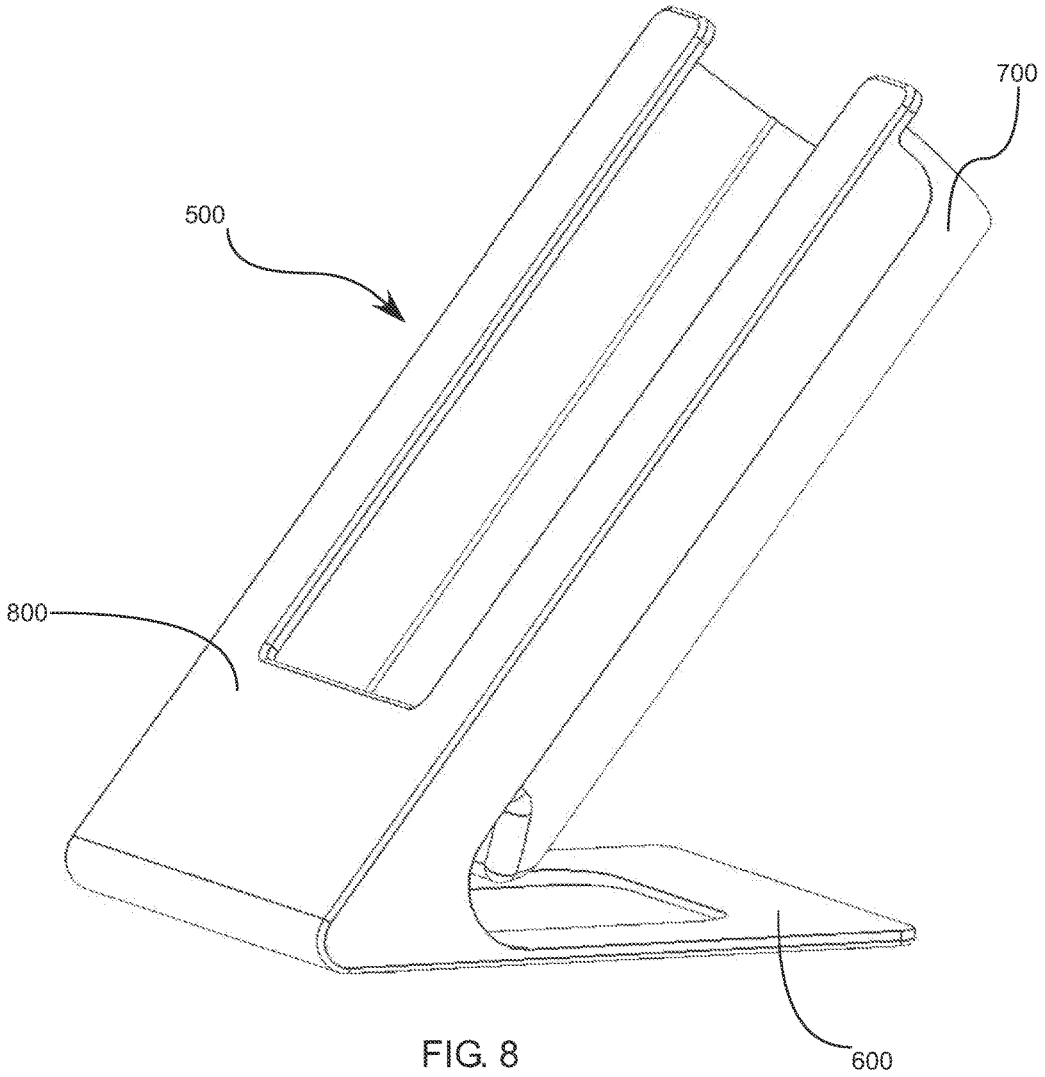
FIG. 8 illustrates a perspective view of a bottle stand assembly in accordance with an alternative embodiment, the bottle stand assembly having a unitary stand and faceplate assembly.
Figure 9A:
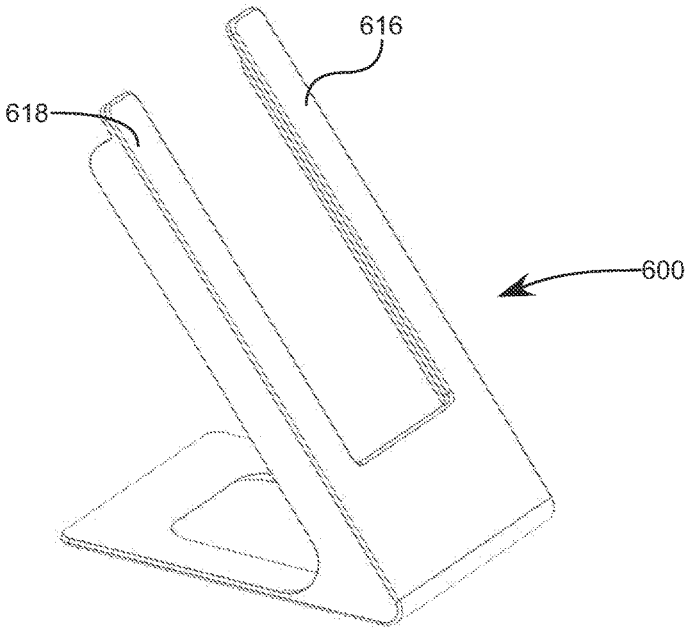
FIGS. 9A-B illustrate various views of a stand portion of the bottle stand assembly in accordance with the embodiment of FIG. 8
Figure 9B:
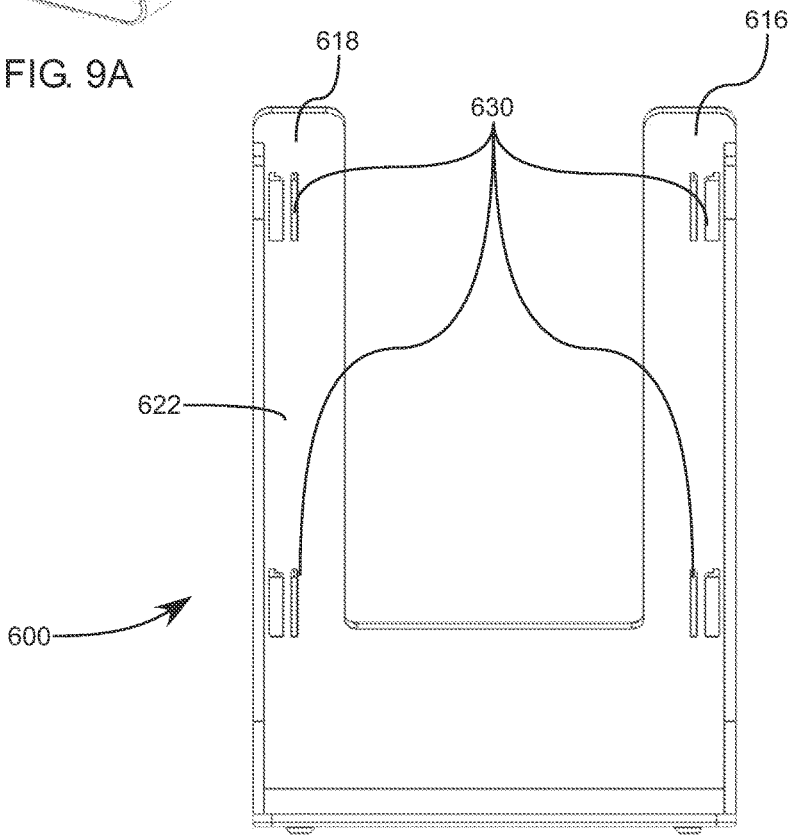
Figure 10A:
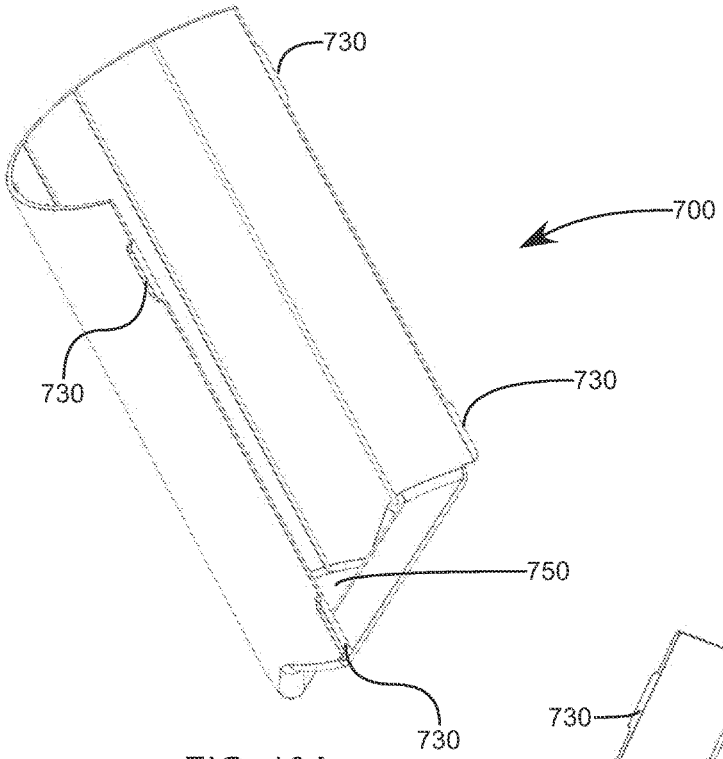
FIGS. 10A-B illustrate various views of a barrel insert for use with the bottle stand assembly in accordance with the embodiment of FIG. 8.
Figure 10B:
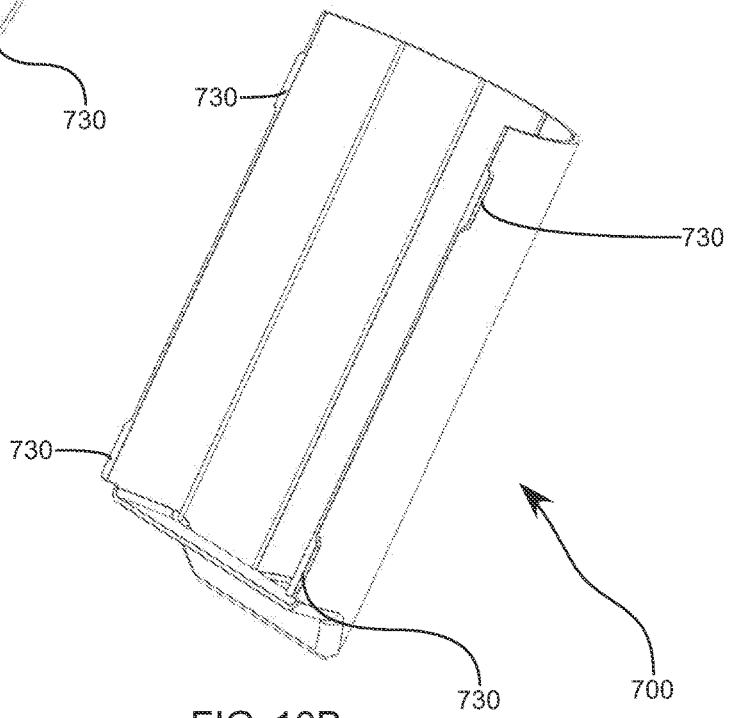

FIG. 8 illustrates an alternative embodiment of a bottle holder assembly 500 in accordance with yet another aspect of the present invention. This embodiment also includes a stand 600, however the stand is provided with an annular holding portion 700 which is removable from the stand 600. It will be appreciated that the stand 600 can also be provided with a removable face plate 800, or the face plate 800 can be unitarily formed with the stand 600.

As shown in FIGS. 9A-B-10A-B, the stand 600 can be provided with an alternative slide lock system having first components 630 in the form of channels which are located on a rear surface 622 of first and second prongs, 616 and 618, of the stand. Corresponding tabs 730 can be provided about a peripheral edge of the annular holding portion 700 wherein the annular holding portion 700 can be slid into channels and thereby interferingly engaged. The annular holding portion 700 can be provided with any of the features discussed above with respect to the first embodiment, including a reservoir cavity 750. In the present embodiment the reservoir cavity can further act as a stop wherein when the annular holding portion is fully inserted the bottom of the reservoir cavity abuts against the stand and prevents the tabs for extending below the channels of the stand.

Figure 11:
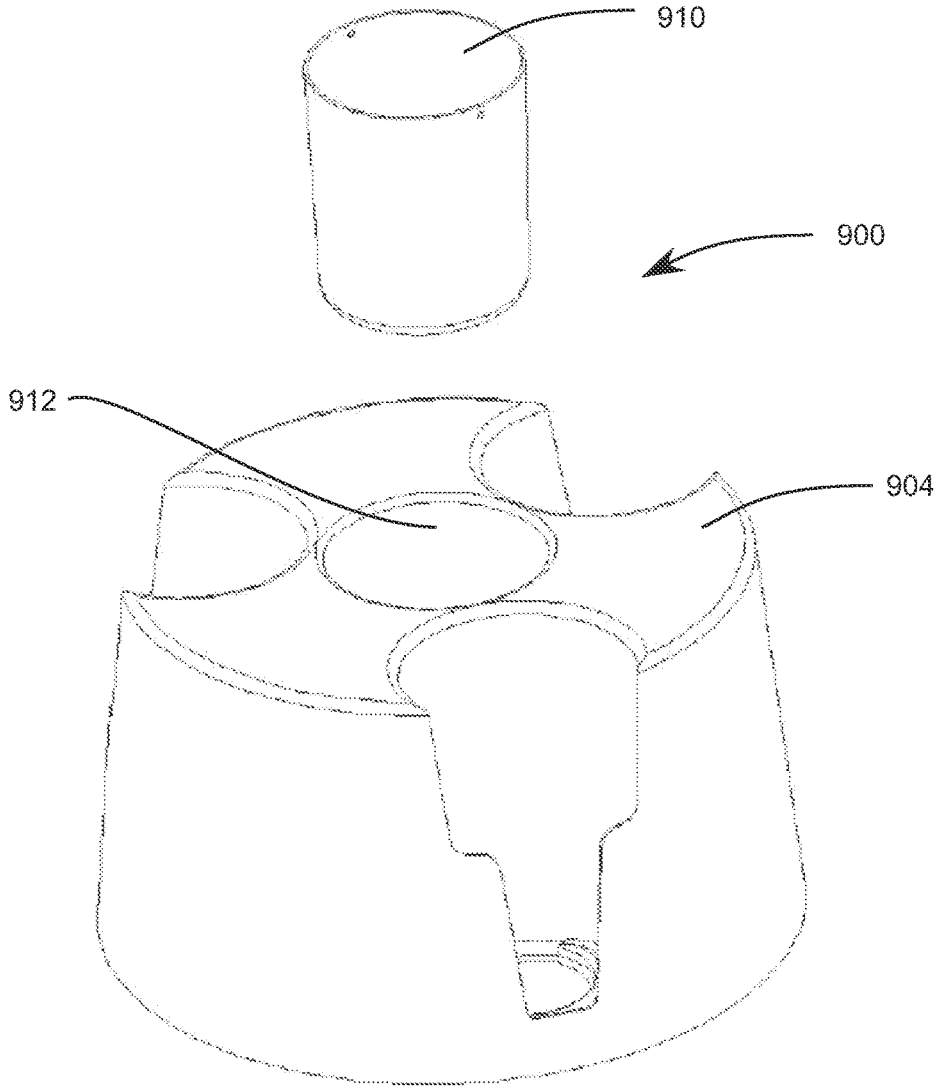
FIG. 11 illustrates an alternative embodiment wherein numerous bottle stand assemblies can be combined to form a multi-faceted bottle stand assembly capable of holding a plurality of bottles.
Figure 12A:
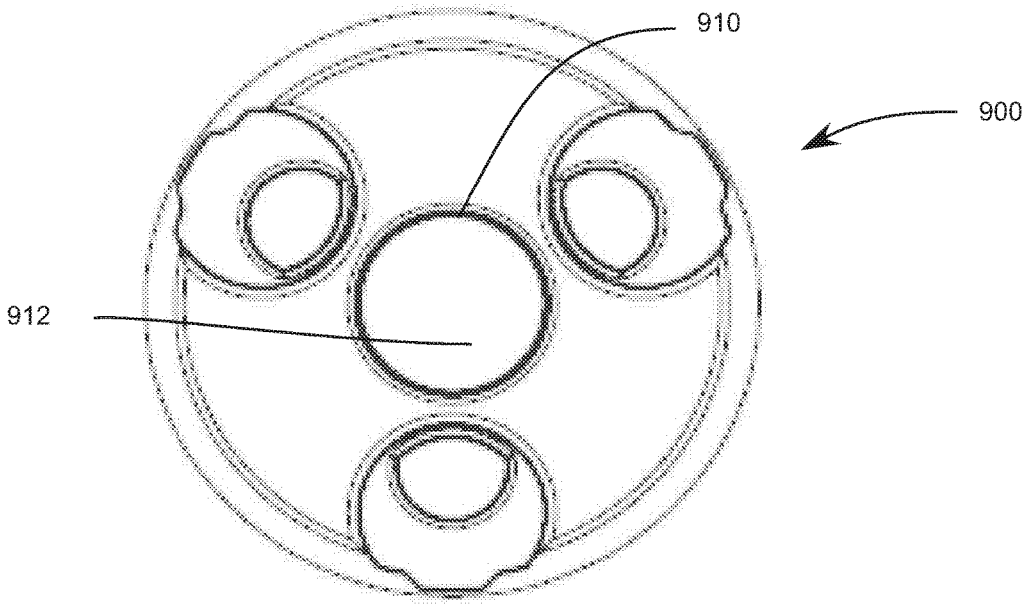
FIGS. 12A-B illustrate top and bottom views of the embodiment shown in FIG. 11.
Figure 12B:
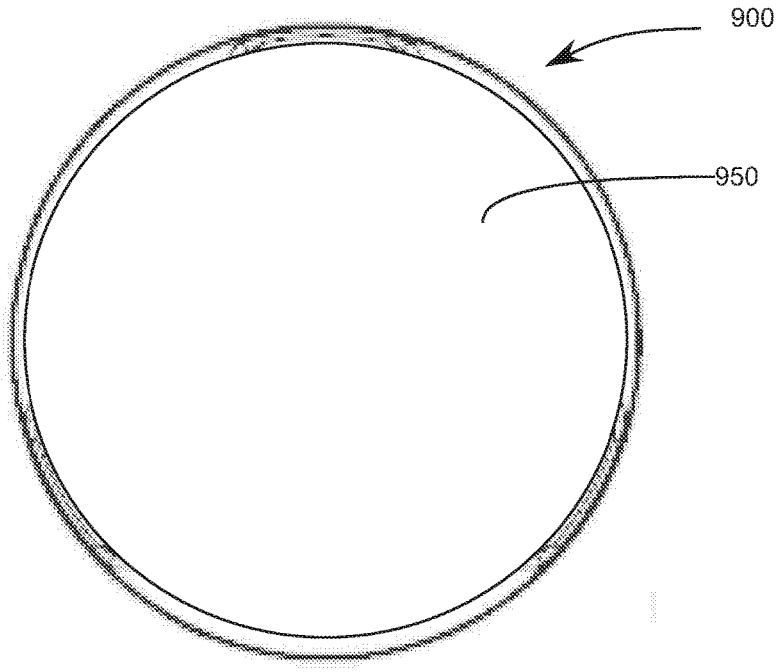

As illustrated in FIGS. 11-12, yet another embodiment of the present invention is shown, which is presented in the form of a multiple bottle holder 900. The multiple bottle holder 900 utilizes a plurality bottle holders in accordance with the aforementioned embodiments, but orients them facing outward from one another and interconnects them or unitarily forms them so as to provide a bottle holder capable of holding numerous bottles. The outer circumference can be provided having a round conical shape, as shown, or can be faceted to allow for the use of replaceable face plates in accordance with the aforementioned embodiments.

The multiple bottle holder 900 can be provided with a rotable plate 950 which allows the entire stand 904 to spin upon the rotable plate 950. The rotable plate 950 can be provided with low friction rotational components similar to a Lazy Susan, via ball bearings, low friction plates, etc.

The multiple bottle holder 900 can further be provided with a central container 910 which can be configured to contain ice or some other substance. The ice contained therein can then be added to individual's drinking glasses as desired along with the beverages contained in the associated bottles. Further the central container 910 can be placed inside a central cavity 912 and be removed for appropriate cleaning.

It will be appreciated that the multiple bottle holder can utilize any of the features or arrangements discussed above with respect to the single units, i.e. have removable bottle holders, reservoirs, etc. The embodiment shown in FIG. 11 is for illustrative purposes only.

Figure 13A:
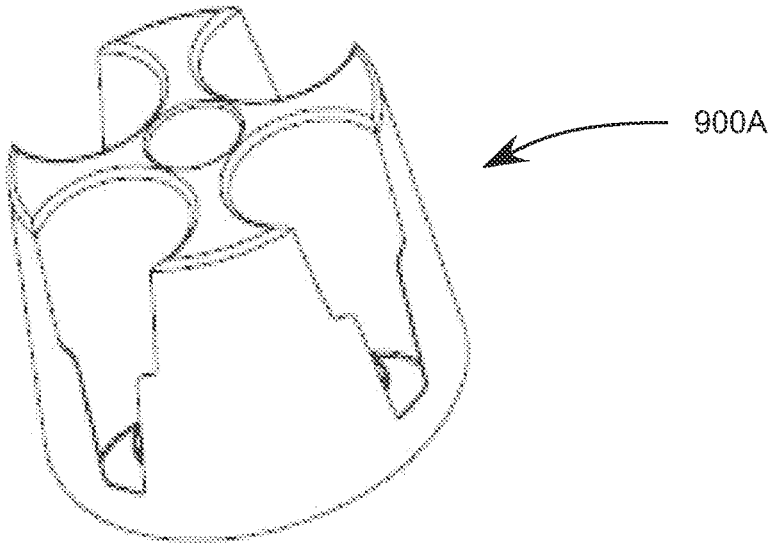
FIGS. 13A-B illustrate isometric and top views of yet another embodiment of a cooling bottle holder in accordance with another aspect of the present invention which utilizes more stand assemblies than the embodiment of FIG. 11.
Figure 13B:
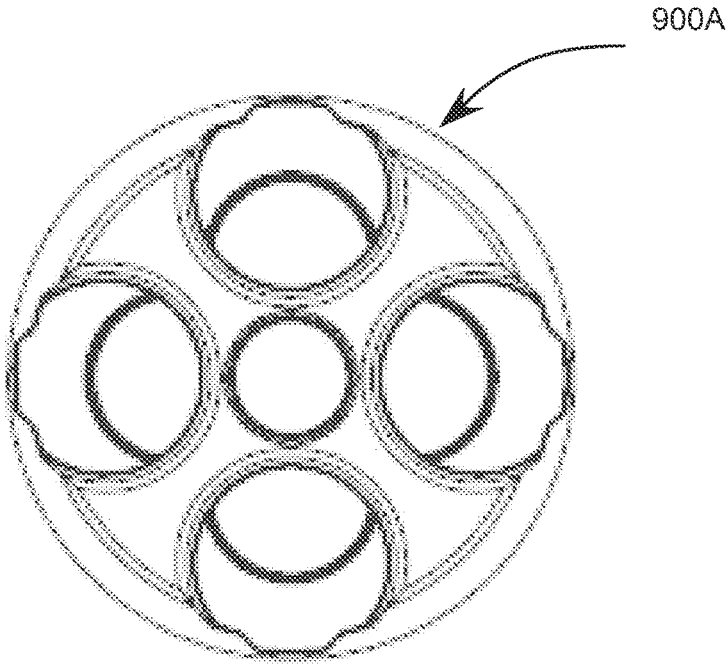

FIGS. 13A-B illustrate yet another embodiment of a cooling bottle holder 900A in accordance with various aspects of the present invention. FIG. 13A illustrates an isometric view, and FIG. 13B illustrates a top view. This embodiment utilizes yet more additional annular holding portions, i.e. 4 instead of 3. It will be appreciated that as more annular holding portions for additional bottles are provided that the central cavity can be re-sized to accommodate the additional annular holding portions.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied. Accordingly, additions and modifications can be made without departing from the principles of the disclosure. In this regard, it is intended that such changes would still fall within the scope of the disclosure. Therefore, this disclosure is not limited to particular embodiments, but is intended to cover modifications within the spirit and scope of the disclosure.

What is claimed is:

1. A bottle holder assembly comprising:

a stand, the stand further having, an integral angled stand portion and a base portion, the base portion configured to rest against a supportive surface, the integral angled stand portion extending upward away from the base portion and having first and second prongs forming a primary void in a front planar face therebetween, and an annular holding portion integral with the angled stand portion, the annular holding portion extending rearwardly from the front planar face between the first and second prongs;

a removable face plate configured to engage with the front planar face of the integral angled stand portion of the stand, the removable face plate being shaped so as to cover the front planar face, and the first and second prongs of the integral angled stand portion thereby leaving a majority of the primary void open; and a cooling insert configured to rest in the annular holding portion between the removable face plate and the stand.

2. The bottle holder assembly of claim 1, further comprising a sliding lock system, the sliding lock system having, a plurality of first components being provided on the first and second prongs of the integral angled stand portion, and a plurality of second components being provided on a rear surface of the removable face plate, wherein the sliding lock system is operable to secure the removable face plate to the integral angled stand portion.

3. The bottle holder assembly of claim 2, wherein the sliding lock system further comprises a secondary void formed in the front planar face between the first and second prongs below the primary void, and the plurality of first components includes one or more tabs extending from each of the first and second prongs into the secondary void.

4. The bottle holder assembly of claim 3, wherein the plurality of second components of the sliding lock system includes one or more channeled extensions provided on a rear surface of the removable face plate being configured to engage with the one or more tabs.

5. The bottle holder assembly of claim 2, wherein the sliding lock system further comprises a secondary void formed in the front planar face between the first and second prongs below the primary void, and the plurality of first components includes one or more channeled extensions extending from each of the first and second prongs into the secondary void.

6. The bottle holder assembly of claim 5, wherein the second component of the sliding lock system includes one or more tabs provided on a rear surface of the removable face plate being configured to engage with the one or more channeled extensions.

7. The bottle holder assembly of claim 1, wherein an interior surface of the cooling insert is provided having a malleable interior surface configured to conform to the shape of a bottle placed into the annular holding portion.

8. The bottle holder assembly of claim 1, wherein the annular holding portion further comprises a reservoir cavity which extends below a holding edge of the stand.

9. The bottle holder assembly of claim 1, further comprising a stiffening ridge formed at least partially between each of the first and second prongs and the base portion.

10. The bottle holder assembly of claim 1, wherein the base portion further has a front lip portion which bends upward until parallel with the front planar face, the front lip portion providing a flush edge provided about an upper portion of the front lip portion against which the removable face plate can rest in a locked configuration, a bottom edge of the removable face plate abutting against the flush edge of the front lip portion so as to have no void therebetween in the locked configuration.

11. The bottle holder assembly of claim 1, wherein the annular holding portion is provided with a series of ridges, the series of ridges being configured to stabilize an angular position of the cooling insert provided therein.

12. A bottle holder assembly, comprising:

a stand, the stand further having, an integral angled stand portion and a base portion, the base portion configured to rest against a supportive surface, the integral angled stand portion extending upward away from the base portion and having first and second prongs forming a primary void in a front planar face therebetween, and a removable face plate configured to engage with the front planar face of the integral angled stand portion of the stand, the removable face plate being configured to cover the front planar face, and the first and second prongs of the integral angled stand portion and leaving a majority of a front portion of the primary void open;

an annular holding portion being removably coupled to a rear surface of the integral angled stand portion extending rearwardly from the front planar face between the first and second prongs substantially closing a rear portion of the primary void; and a cooling insert configured to rest in the annular holding portion.

13. The bottle holder assembly of claim 12, further comprising a sliding lock system having first components and second components, wherein the first components of the sliding lock system reside on the rear surface of the integral angled stand portion, and the second components of the sliding lock system reside on the annular holding portion, the sliding lock system operable to secure the annular holding portion to the integral angled stand portion.

14. The bottle holder assembly of claim 12, wherein an interior surface of the cooling insert is provided with a malleable surface configured to conform to the shape of a bottle placed into the annular holding portion.

15. The bottle holder assembly of claim 12, further comprising a holding edge provided about a bottom portion of the annular holding portion; and a reservoir cavity which extends below the holding edge.

* * * * *